US007714518B2

(12) United States Patent
Wong et al.

(10) Patent No.: US 7,714,518 B2
(45) Date of Patent: May 11, 2010

(54) BALLAST FOR COLD CATHODE FLUORESCENT LAMP

(75) Inventors: Shih-Fang Wong, Taipei Hsien (TW); Tsung-Jen Chuang, Taipei Hsien (TW); Jun Li, Shenzhen (CN)

(73) Assignee: Hong Fu Jin Precision Industry (ShenZhen) Co., Ltd., Shenzhen, Guangdong Province (CN)

( * ) Notice: Subject to any disclaimer, the term of this patent is extended or adjusted under 35 U.S.C. 154(b) by 371 days.

(21) Appl. No.: 11/770,749

(22) Filed: Jun. 29, 2007

(65) Prior Publication Data

US 2008/0100229 A1 May 1, 2008

(30) Foreign Application Priority Data

Oct. 30, 2006 (CN) ..... 2006 1 0201048

(51) Int. Cl.
*G05F 1/00* (2006.01)

(52) U.S. Cl. ..... 315/291; 315/307; 315/224; 315/274; 315/209 R

(58) Field of Classification Search ..... 315/224, 315/225, 247, 246, 209 R, 274–289, 291, 315/307–311

See application file for complete search history.

(56) References Cited

U.S. PATENT DOCUMENTS

| | | | | |
|---|---|---|---|---|
| 5,027,032 | A | 6/1991 | Nilssen | |
| 5,717,295 | A * | 2/1998 | Nerone | 315/307 |
| 6,011,360 | A | 1/2000 | Gradzki et al. | |
| 6,900,599 | B2 | 5/2005 | Ribarich | |
| 7,279,848 | B2 * | 10/2007 | Heckmann et al. | 315/209 R |
| 7,365,500 | B2 * | 4/2008 | Jang | 315/274 |
| 2001/0035721 | A1 * | 11/2001 | Halberstadt | 315/219 |

* cited by examiner

*Primary Examiner*—Tuyet Vo
(74) *Attorney, Agent, or Firm*—Frank R. Niranjan

(57) ABSTRACT

A ballast includes a drive circuit, a half-bridge inverter, a transformer, and a filter. The drive circuit is configured for generating a drive signal on receiving a power. The half-bridge inverter is configured for generating a power AC signal according to the drive signal generated by the driver. The power AC signal is fed back to the drive circuit, for determining a non-overlap time of the drive signal. The transformer is configured for generating a high frequency signal based on the power AC signal. The high frequency signal is configured for lightening a lamp, and maintaining the lightening of the lamp. The filter is used for filtering out noise in the feedback power AC signal.

18 Claims, 11 Drawing Sheets

| PIN NO. | SYMBOL | DESCRIPTION | PIN NO. | SYMBOL | DESCRIPTION |
|---|---|---|---|---|---|
| 1 | CT | IGNITION TIMER OUTPUT | 9 | $FV_{DD}$ | FLOATING SUPPLY; SUPPLY FOR THE HIGH SIDE SWITCH |
| 2 | CSW | VOLTAGE CONTROLLED OSCILLATOR INPUT | 10 | GH | GATE OF THE HIGH SIDE SWITCH OUTPUT |
| 3 | CF | VOLTAGE CONTROLLED OSCILLATOR OUTPUT | 11 | SH | SOURCE OF THE HIGH SIDE SWITCH |
| 4 | $I_{REF}$ | INTERNAL REFERENCE CURRENT INPUT | 12 | ACM | CAPACITIVE MODE INPUT |
| 5 | GND | GROUND | 13 | LVS | LAMP VOLTAGE SENSOR INPUT |
| 6 | GL | GATE OF THE LOW SIDE SWITCH OUTPUT | 14 | $V_{REF}$ | REFERENCE VOLTAGE OUTPUT |
| 7 | $V_{DD}$ | LOW VOLTAGE SUPPLY | 15 | CS+ | AVERAGE CURRENT SENSOR POSITIVE INPUT |
| 8 | n.c. | NOT CONNECTED | 16 | CS− | AVERAGE CURRENT SENSOR NEGATIVE INPUT |

FIG. 3

BALLAST FOR COLD CATHODE FLUORESCENT LAMP

BACKGROUND OF THE INVENTION

1. Field of the Invention

The present invention generally relates to a ballast, and more particularly relates to a ballast for a cold cathode fluorescent lamp (CCFL).

2. Description of Related Art

Liquid crystal displays (LCDs) are used in a variety of environments ranging from televisions to computers. Cold cathode fluorescent lamps (CCFL) are common light sources used in the LCDs, because of their high brightness, low power consumption and low heat-generation.

Ballasts are used for controlling the CCFL during startup and operation. Typically, a ballast includes an oscillator, a drive circuit, a half-bridge inverter, and a resonant LC circuit. The oscillator is used for generating a series of pulses, and applying the pulses to the drive circuit. The drive circuit is configured for outputting two drive signals to the half-bridge inverter on receiving the pulses. The two drive signals are applied to two field effect transistors (FET) in the half-bridge inverter, for driving the two FETs, to be turned on alternatively. The half-bridge inverter outputs a square wave accordingly. The square wave is applied to the resonant LC circuit, thus the resonant LC circuit sends a high-level signal, for driving the CCFL to start to work.

The output of the half-bridge inverter directly depends on a non-overlapping time of the two drive signals, further affecting the startup of the CCFL. However, as the drive circuit outputs the drive signals without any feedback, it is difficult to adjust the non-overlapping time of the two drive signals, thus the non-overlapping time of the two drive signals may not be consistent with each other. Furthermore, as there are a lot of external and internal interferences and noise, the non-overlapping time becomes unstable, which causes difficulty in the starting of the CCFL.

Therefore, it is an object of the present invention to provide a kind of ballast which is able to stably drive the CCFL.

SUMMARY OF THE INVENTION

A ballast includes a drive circuit, a half-bridge inverter, a transformer, and a filter. The drive circuit is configured for generating a drive signal on receiving a power. The half-bridge inverter is configured for generating a power AC signal according to the drive signal generated by the driver. The power AC signal is fed back to the drive circuit, for determining a non-overlap time of the drive signal. The transformer is configured for generating a high frequency signal based on the power AC signal. The high frequency signal is configured for lightening a lamp, and maintaining the lightening of the lamp. The filter is used for filtering out noise in the feedback power AC signal.

A ballast includes a driver, an inverter, and a transformer. The driver is configured for outputting a high-side drive signal and low-side drive signal. The high-side drive signal and the low-side drive signal are high-leveled alternatively. The inverter includes a high switch transistor for receiving the high-side drive signal and a low switch transistor for receiving the low-side drive signal. The high switch transistor and the low switch transistor are serially connected, for outputting a power AC signal. The transformer is configured for outputting a high frequency signal based on the power AC signal, for lightening a lamp and maintaining the lightening of the lamp.

The power AC signal is also fed back to the driver, for controlling a non-overlap time of the drive signal outputted from the driver.

Other systems, methods, features, and advantages of the present ballast will be or become apparent to one with skill in the art upon examination of the following drawings and detailed description. It is intended that all such additional systems, methods, features, and advantages be included within this description, be within the scope of the present system and method, and be protected by the accompanying claims.

BRIEF DESCRIPTION OF THE DRAWINGS

Many aspects of the present ballast can be better understood with reference to the following drawings. The components in the drawings are not necessarily to scale, emphasis instead being placed upon clearly illustrating the principles of the inventive system and method. Moreover, in the drawings, like reference numerals designate corresponding parts throughout the several views.

FIG. 3 is the function of each pin of the ballast driver IC illustrated in FIG. 2;

DETAILED DESCRIPTION OF THE INVENTION

Reference will now be made to the drawings to describe a preferred embodiment of the inventive ballast.

Figure 1:
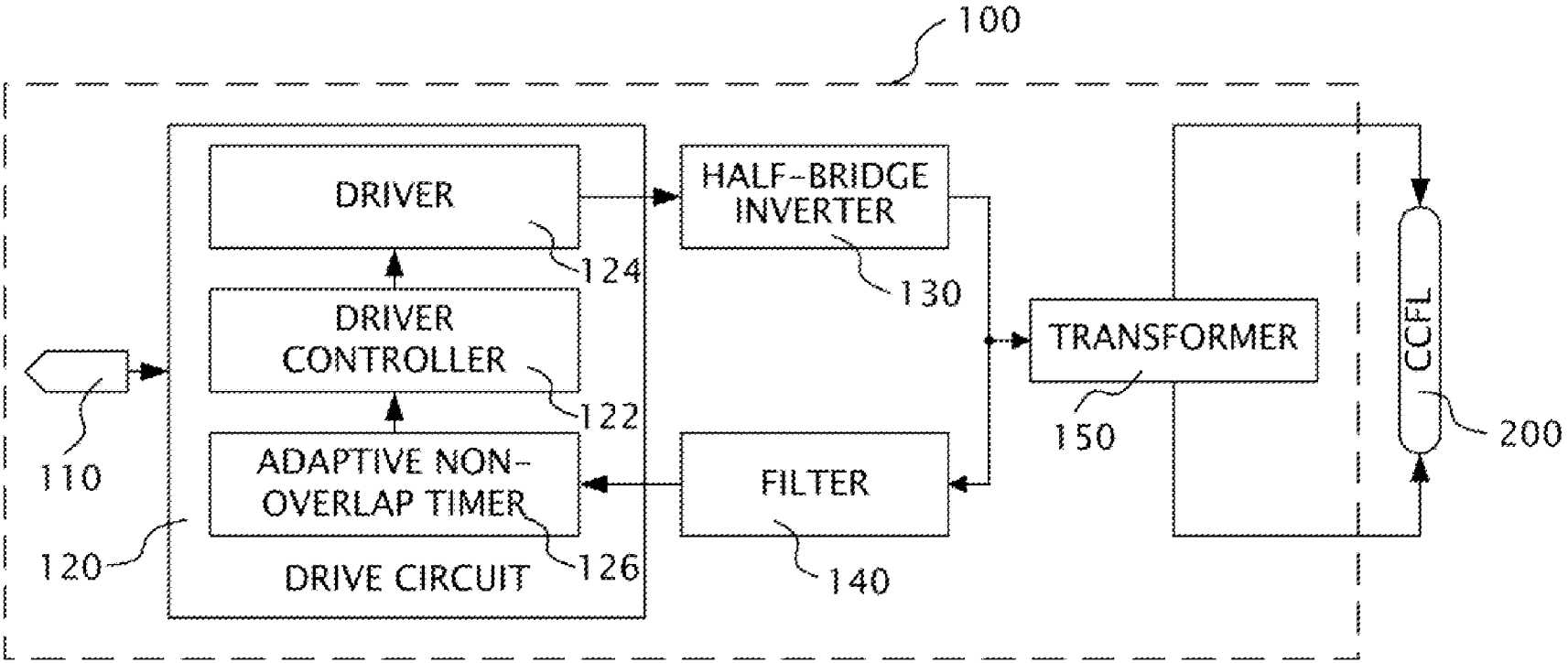
FIG. 1 is a block diagram of a ballast in accordance with an exemplary embodiment.

Referring to FIG. 1, a block diagram of a ballast in accordance with an exemplary embodiment is illustrated. The ballast 100 includes an input end 110, a drive circuit 120, a half-bridge inverter 130, a filter 140, and a transformer 150.

The input end 110 is configured for receiving a power for the Cold Cathode Fluorescent Lamp (CCFL) 200. The input end 110 forwards the power to the drive circuit 120.

The drive circuit 120 includes a drive controller 122, a driver 124, and an adaptive non-overlap timer 126. The drive controller 122 is used for driving the driver 124 to output a drive signal when the power signal is received. The drive signal is applied to the half-bridge inverter 130.

The half-bridge inverter 130 outputs a power AC signal according to the drive signal. The power AC signal is sent to the transformer 150 and the transformer 150 sends a high frequency signal to the CCFL 200, thus, powering the CCFL 200.

The power AC signal is further fed back to the adaptive non-overlap timer 126 via the filter 140. The adaptive non-overlap timer 126 determines a non-overlap time of the drive signal outputted by the driver 124 according to a slope of a feedback signal generated by the filter 140. The adaptive non-overlap timer 126 controls the drive controller 124 according to the determined non-overlap time.

Figure 2:
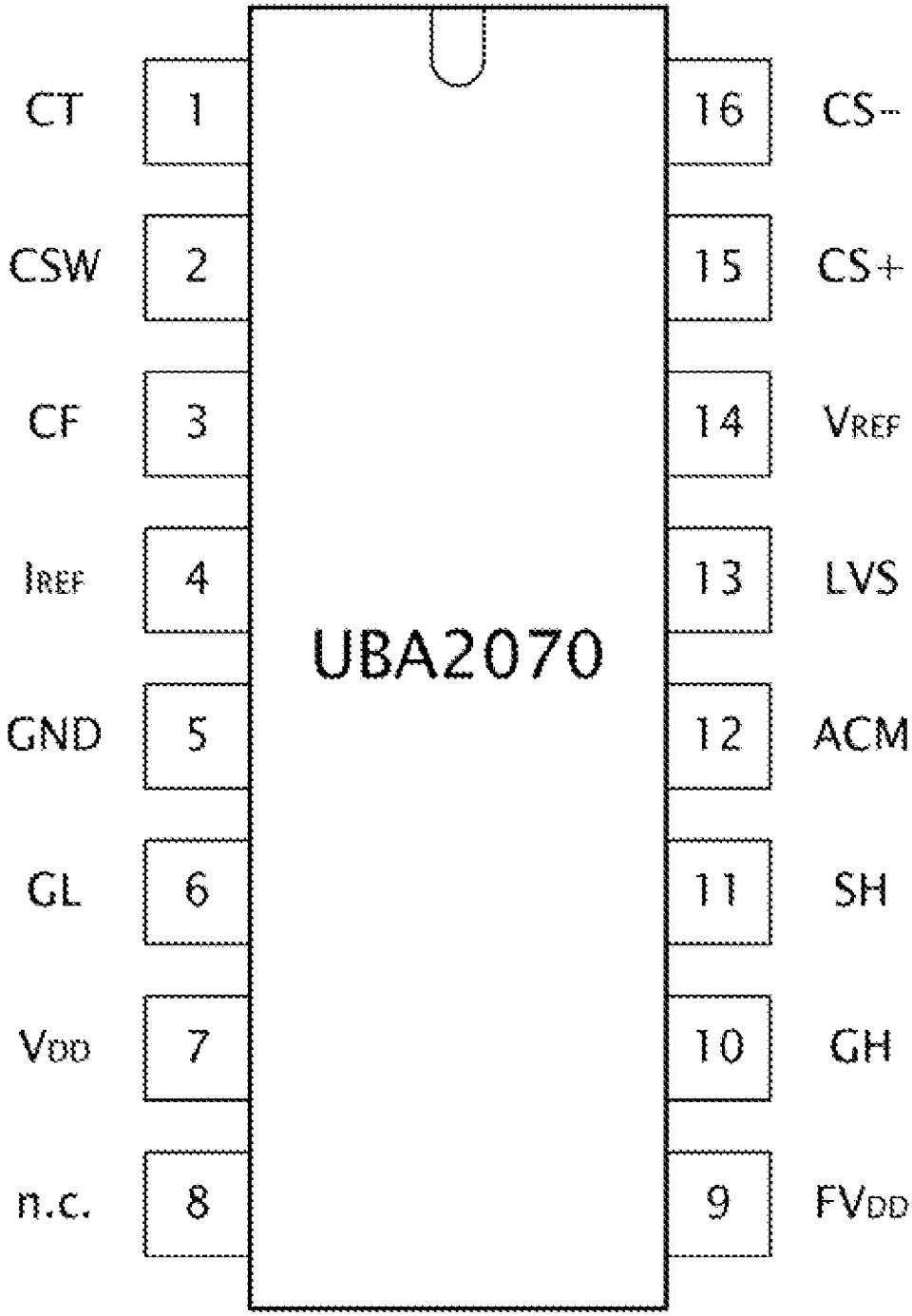
FIG. 2 is a terminal pin arrangement for a ballast driver IC.

Referring to FIG. 2 and FIG. 3, a terminal pin arrangement for a ballast driver IC and a function of each pin is illustrated. In the preferred embodiment, The ballast driver IC is the UBA2070 manufactured by Philips. The ballast driver IC is used for driving fluorescent lamps, and especially for ballast circuits used in a drive circuit for cold cathode fluorescent lamps (CCFL).

Figure 4:
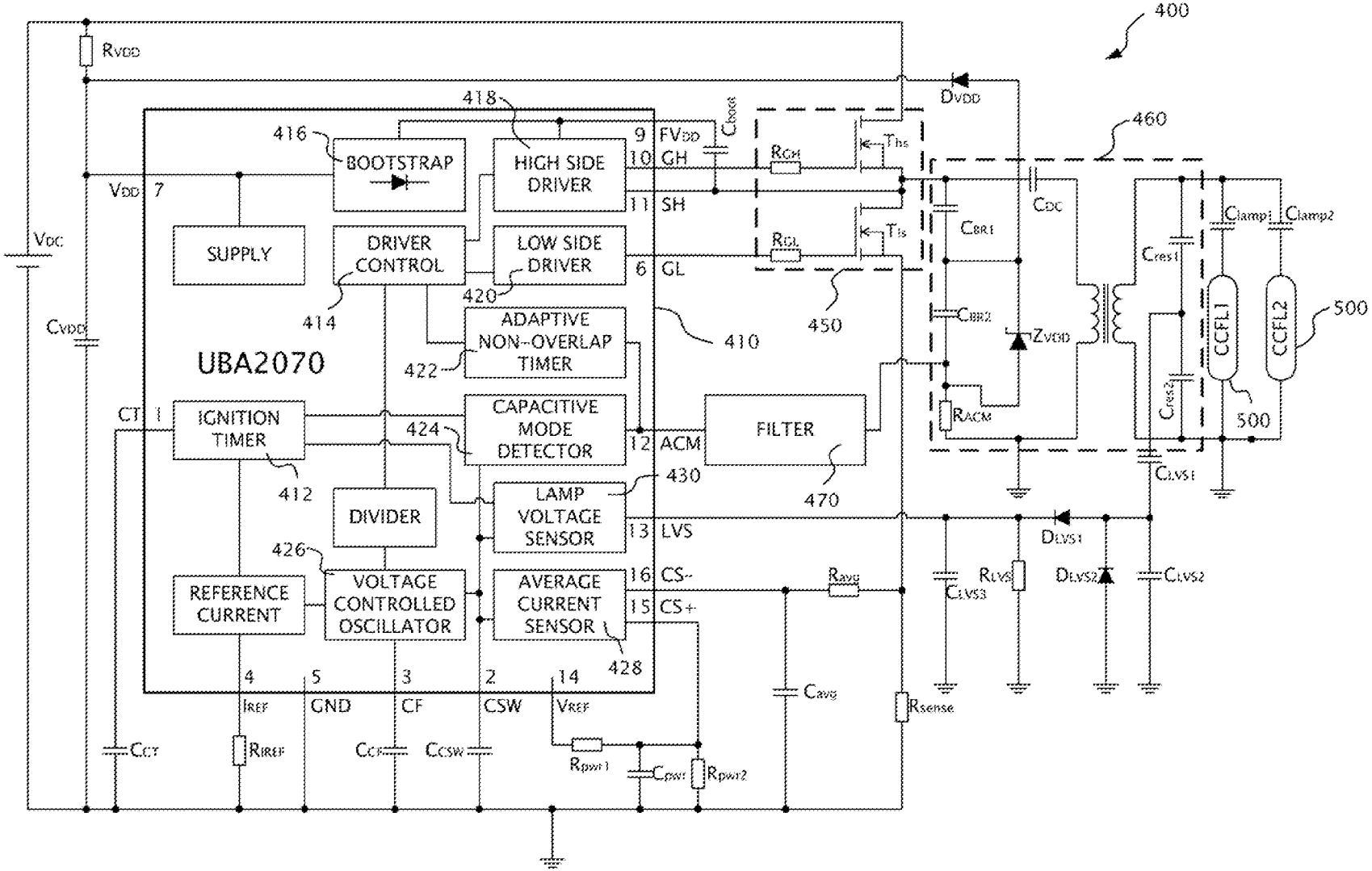
FIG. 4 is a schematic diagram of the ballast in accordance with an exemplary embodiment.

Referring to FIG. 4, a schematic diagram of the ballast in accordance with an exemplary embodiment is illustrated. The driver IC UBA2070 as shown in FIG. 2 is incorporated in the ballast 200 as the drive circuit (as the drive circuit 120 shown in FIG. 1). The ballast 400 includes a drive circuit 410, a half-bridge inverter 450, a transformer 460, and a filter 470.

The driver circuit 410 includes a high side driver 418 and a low side driver 420. Pin 10 and pin 6 of the driver circuit 410 are respectively connected to the high side driver 418 and the low side driver 420. The high side driver 418 and the low side driver 420 make up of a driver (not labeled) as the driver 124 illustrated in FIG. 1. The high side driver 418 and the low side driver 420 are used for outputting drive signals to the half-bridge inverter 450. The half-bridge inverter 450 includes a high switch transistor $T_{hs}$ and a low switch transistor $T_{ls}$. The signal GH, which is outputted by the high side driver 418 to the pin 10 of the drive circuit 410, is applied to the high switch transistor $T_{hs}$. The signal GL, which is outputted by the low side driver 418 to the pin 6 of the drive circuit 410, is applied to the low switch transistor $T_{ls}$. The half-bridge inverter 450 thus outputs the power AC signal to the transformer 460. The transformer 460 provides a high frequency signal for the CCFLs that are connected in parallel with the transformer 460 according to the power AC signal.

A work principle of the ballast 400 will be described to show a further detailed structure of the ballast 400. Referring to FIG. 4, after a power supply $V_{DC}$ is applied to the ballast 400, a charge current, which flows through a start-up resistor $R_{VDD}$, charges a capacitor $C_{VDD}$. Accordingly, a voltage $V_{DD}$ on the capacitor $C_{VDD}$ is increased.

When the $V_{DD}$ reaches a predetermined value, such as 13V, a voltage controlled oscillator 426 starts oscillation. The oscillation frequency of the voltage controlled oscillator 426 is determined by a capacitance of a grounded capacitor $C_{CF}$ and a resistance of the reference resistor $R_{IREF}$, The voltage controlled oscillator 426 outputs an oscillation signal CF with a sawtooth waveform to the pin 3 of the drive circuit 410.

Figure 5:
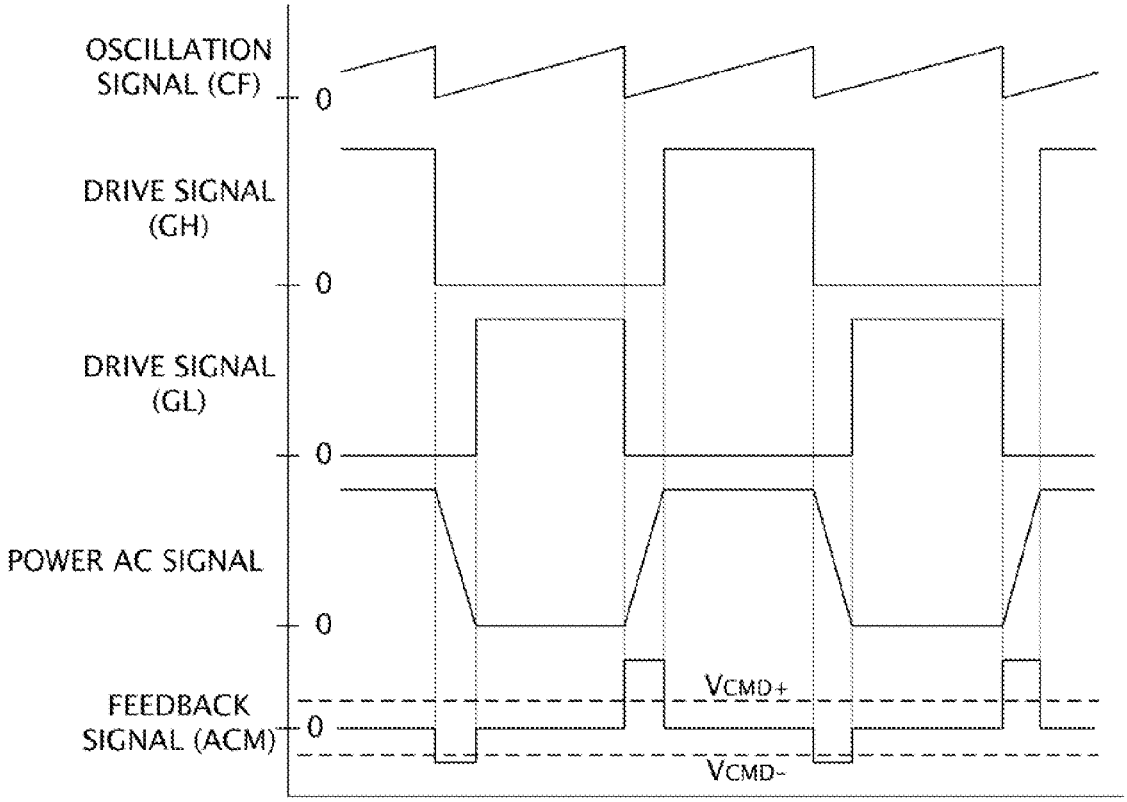
FIG. 5 is a timing diagram of the oscillation signal CF, the drive signals GH and GL, the power AC signal, and the feedback signal ACM.

Referring to FIG. 5, a timing diagram of the oscillation signal CF, the drive signals GH, GL, the power AC signal, and the feedback signal ACM is illustrated. The frequency of the oscillation signal CF is twice that of the drive signals GH, GL. The high switch transistor $T_{hs}$ and a low switch transistor $T_{ls}$ conducts in an alternating manner, thus the non-overlap time of the AC signal is about a quarter of its period time.

After the voltage controlled oscillator 426 starts oscillating, the frequency of the oscillation signal CF tends to decrease because an internally fixed current charges a capacitor $C_{CSW}$ at pin 2 of the drive circuit 410. When the frequency of the oscillation signal CF approaches a resonant frequency of the CCLs 500, the transformer 460 outputs a high level signal that is applied to the CCFLs 500, thus causing the CCFLs 500 to be ignited. The signal applied to the CCFLs 500 (hereinafter refers to lamp voltage) is rectified by a diode $D_{LVS1}$, and filtered by a capacitor $C_{LVS2}$, before being detected by a lamp voltage sensor 430 of the drive circuit 410 via pin 13.

Figure 6:
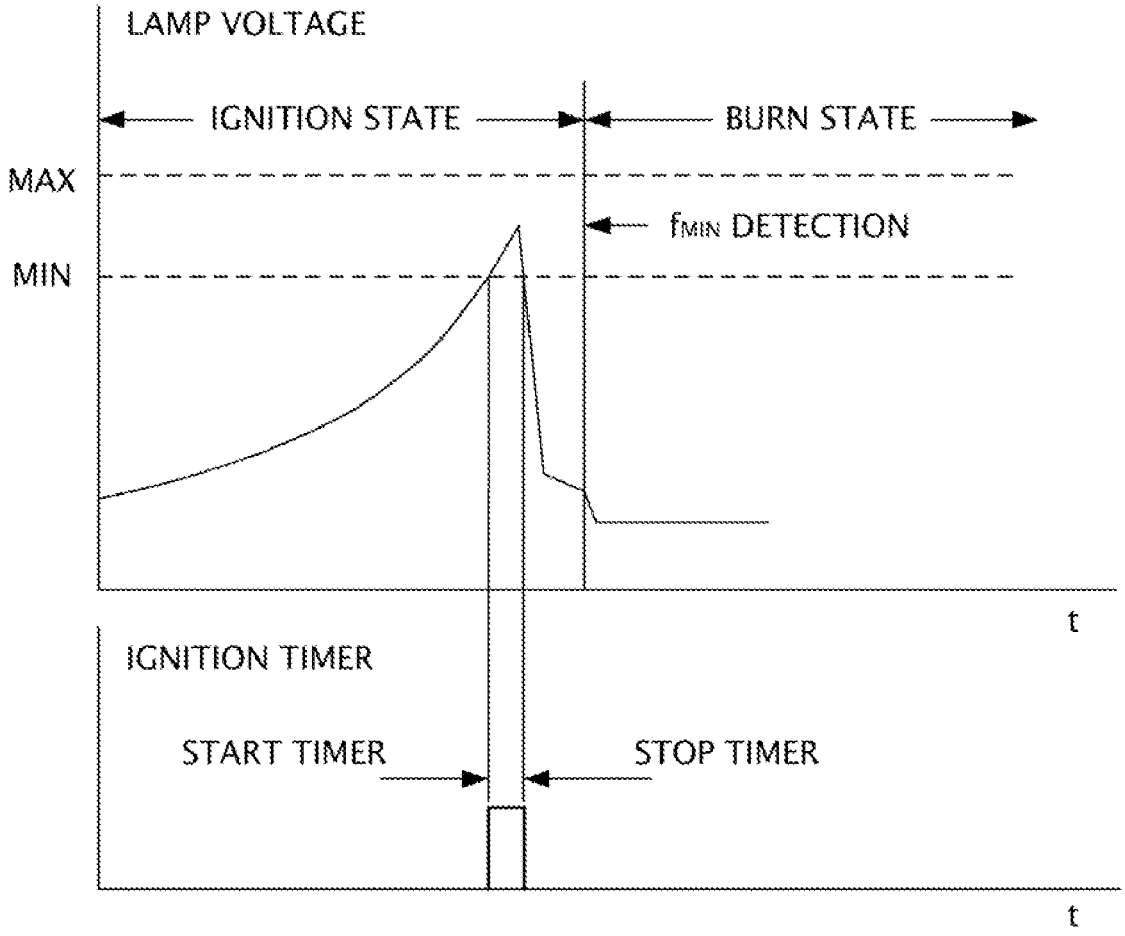
FIG. 6 is a signal timing diagram of the lamp voltage.

Referring to FIG. 6, a timing diagram of the lamp voltage is illustrated. When the lamp voltage becomes higher than a minimum value MIN, an ignition timer 412 of the drive circuit 410 starts. The ignition timer 412 stops when the lamp voltage drops below the minimum value MIN. When the lamp voltage is between the minimum value MIN and a maximum value MAX, a voltage on the pin 2 of the drive circuit 410 will increase to a clamp level, and the frequency of the oscillation signal CF will decrease.

When the frequency of the oscillation signal CF decreases to a threshold $f_{MIN}$, the drive circuit enters a burn state, and the average current sensor 428 is enabled. As soon as the average voltage over a sense resistor $R_{sense}$ reaches a reference level at pin 15 of the drive circuit 410, the average current sensor 428 will allow an average current through the sense resistor $R_{sense}$ to flow to the voltage controlled oscillator 426. This is done to regulate the frequency of the oscillation signal CF, and to regulate a current over the CCFLs 500.

Referring also to FIG. 5, during the non-overlap time, if the feedback signal ACM is not beyond a range of $V_{CMD}$ (greater than $V_{CMD+}$ or less than $V_{CMD-}$), the capacitive mode detector 424 will send an instruction, which indicating that the drive circuit 410 is in capacitive mode of operation. The frequency of the oscillation signal CF will increase to a maximum value $f_{MAX}$.

The high switch transistor $T_{hs}$ and the low switch transistor $T_{ls}$ conducts in an alternating manner, this will cause a lot of noise in the ballast 400. Frequencies of the noise are often different from that of the power AC signal outputted from the half-bridge inverter 450. The noise will thus be fed back to the adaptive non-overlap timer 422 with the feedback signal ACM. The non-overlap time tends be unstable since it is determined by the slope of the feedback signal ACM. The unstable non-overlap time will cause the light emitted by the CCFLs 500 to have an unstable brightness, and may even cause the CCFLs 500 to be unable to be ignited.

The filter 470 is used for filtering the noise in the feedback signal ACM. The filter 470 is a notch type filter, which is used for allowing signals with all-band to pass through except some particular frequencies.

Figure 7:
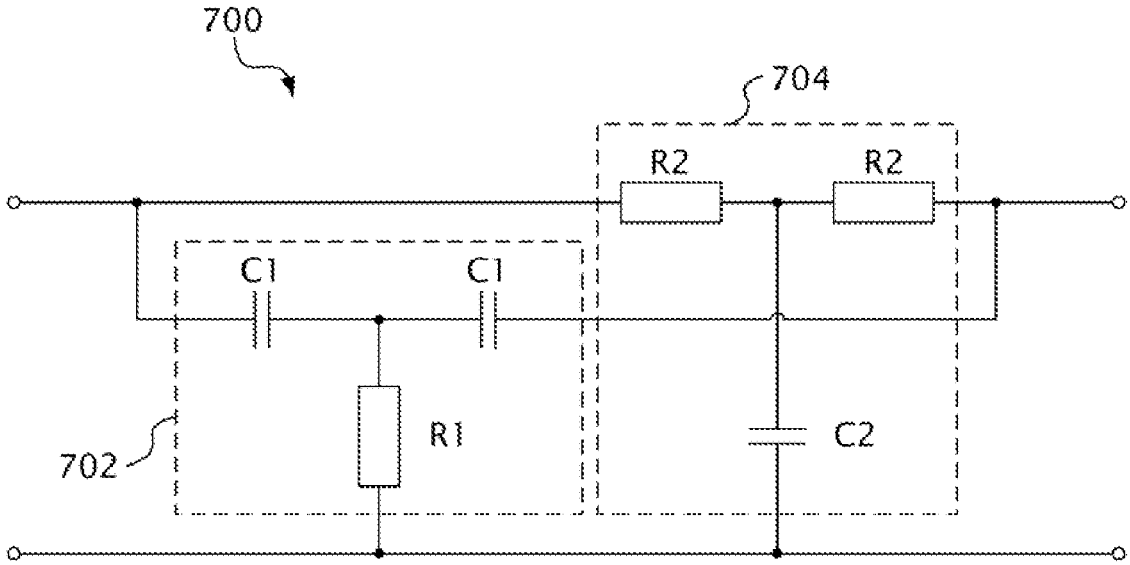
FIG. 7 is a schematic diagram of a notch type filter.

Referring to FIG. 7, a schematic diagram of a notch type filter is illustrated. The notch type filter 700 includes a high-pass filter circuit 702 and a low-pass filter circuit 704. The high-pass filter circuit 702 and the low-pass filter circuit 704 are connected in parallel with each other.

The high-pass filter circuit 702 includes a first resistor R1 with a resistance R and two first capacitors C1, each of the capacitors have a capacitance C. The first resistor R1 and the two first capacitors C1 are connected in a "T" shape. The low-pass filter circuit 704 includes a second capacitor C2 and two second resistors R2. The second capacitor has a capacitance 2C, and the second resistors R2 have a uniform resistance 2R. The second capacitor C2 and the two second resistors R2 are also connected in a "T" shape.

Figure 8:
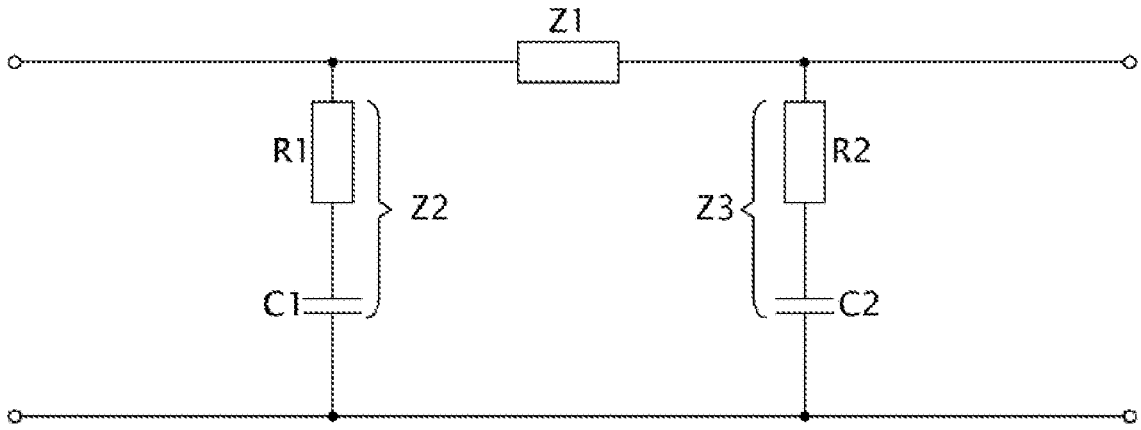
FIG. 8 is an equivalent circuit of the notch type filter as shown in the FIG. 7.

Referring to FIG. 8, an equivalent circuit of the notch type filter 700 as shown in the FIG. 7 is illustrated. In the equivalent circuit, Z1, Z2, and Z3 are equivalent impedances that may be expressed by the following equations:

$$Z_1 = \frac{4R(1+2sRC)}{1+4(sRC)^2} = \frac{4R(1+2j\omega RC)}{1+4(j\omega RC)^2}; \text{ and}$$

$$Z_2 = Z_3 = \frac{1}{2}\left(2R + \frac{1}{sC}\right) = \frac{1}{2}\left(2R + \frac{1}{j\omega C}\right);$$

wherein s refers to the operator in S domain.

A transfer function of the notch type filter 700 can be written in a following equation:

$$F(j\omega) = \frac{Z_3}{Z_1 + Z_3} = \frac{1 - 4(\omega RC)^2}{[1 - 4(\omega RC)^2] + 8j\omega RC} = \frac{1 - (\omega/\omega_0)^2}{[1 - (\omega/\omega_0)^2 + 4j\omega/\omega_0]},$$

wherein j refers to the operator in frequency domain ω stands for an angular frequency, and $\omega_0$ stands for a characteristic angular frequency of the notch type filter 700. $\omega_0$ is expressed by $$\omega_0 = \frac{1}{2RC}.$$

An amplitude-frequency characteristic and a phase-frequency characteristic of the notch type filter 700 can be concluded by the transfer function:

$$|F(j\omega)| = \frac{|1 - (\omega/\omega_0)^2|}{\sqrt{[1 - (\omega/\omega_0)^2]^2 + [4(\omega/\omega_0)]^2}}; \text{ and}$$

$$\varphi = \begin{cases} -\text{arc}tg\dfrac{4(\omega/\omega_0)}{1 - (\omega/\omega_0)^2} & \text{when } \omega/\omega_0 < 1 \\ \pi - \text{arc}tg\dfrac{4(\omega/\omega_0)}{1 - (\omega/\omega_0)^2} & \text{when } \omega/\omega_0 > 1 \end{cases}.$$

Figure 9A:
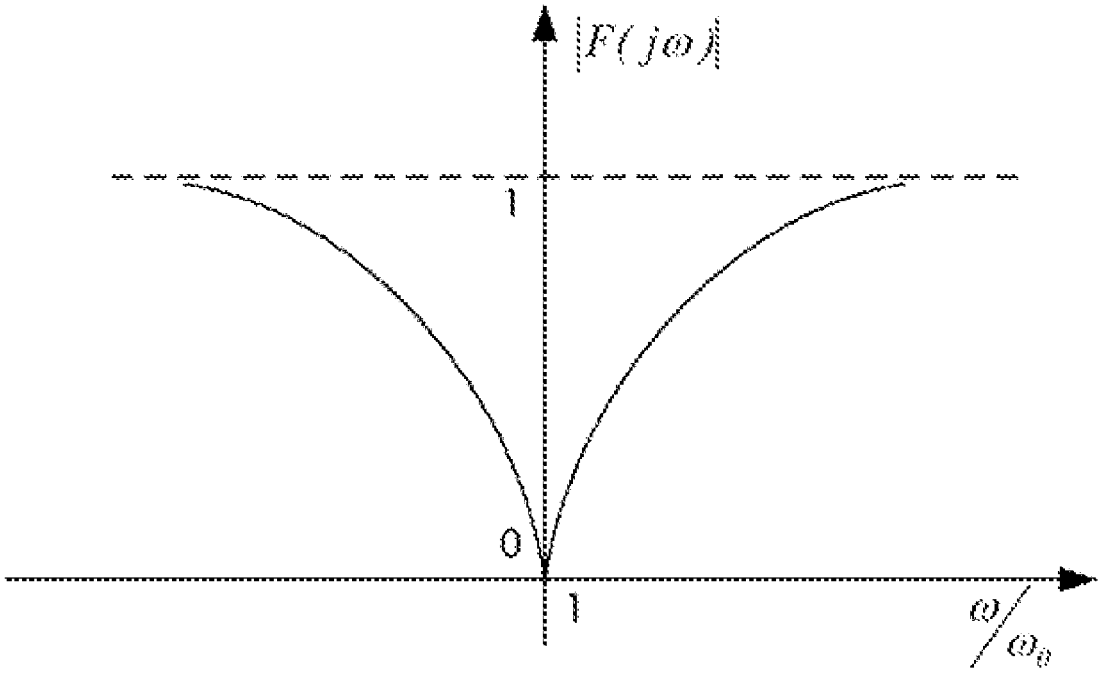
FIG. 9A and FIG. 9B are characteristic diagrams of the notch type filter as shown in the FIG. 7.
Figure 9B:
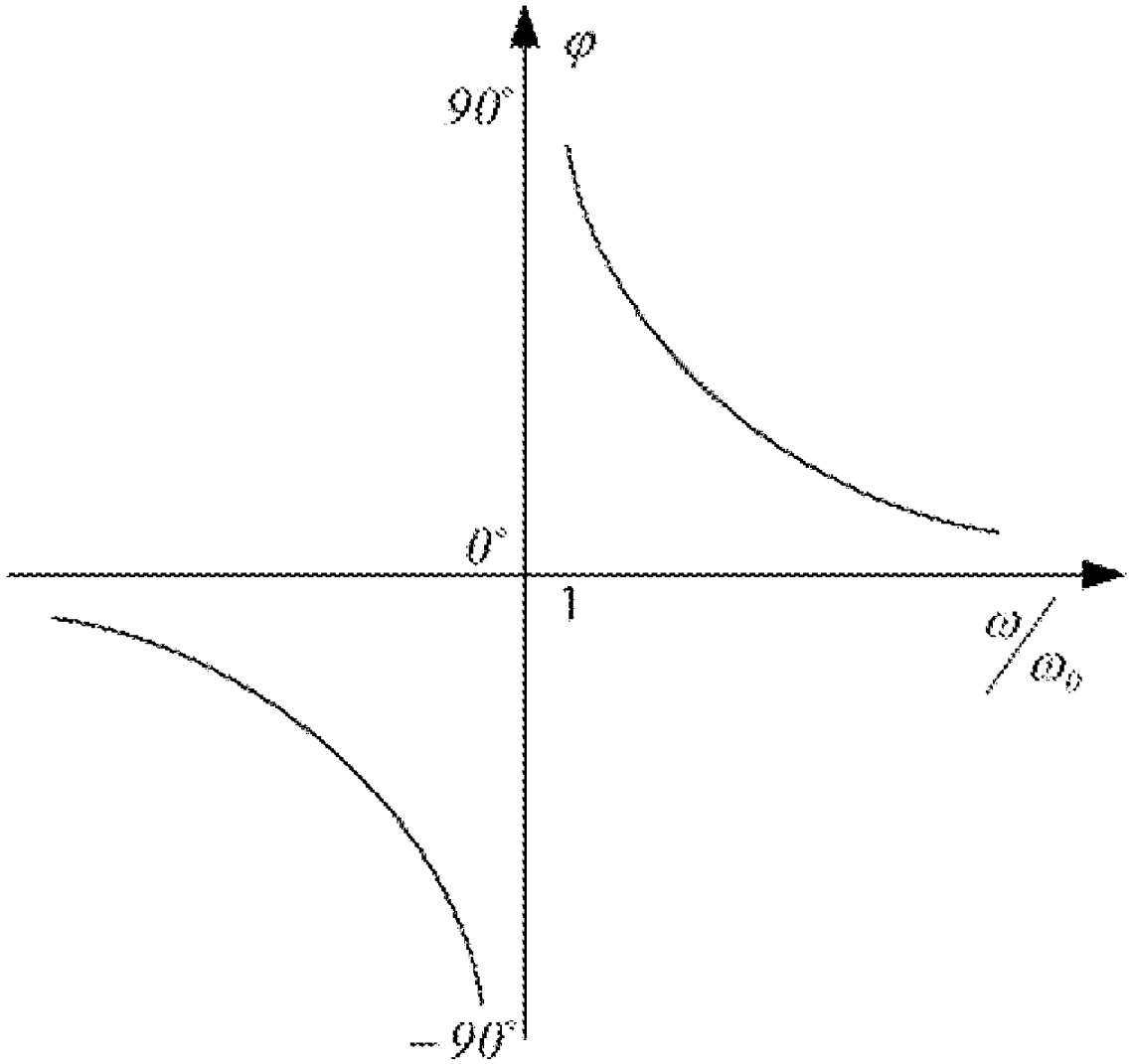

Referring to FIGS. 9A and 9B, characteristic diagrams of the notch type filter 700 as shown in the FIG. 7 are illustrated. FIG. 9A illustrates the characteristic diagram of the amplitude-frequency characteristic. When the angular frequency of an input signal is equal to the characteristic angular frequency of the notch type filter 700, the amplitude of an output signal is about zero. FIG. 9B illustrates the characteristic diagram of the phase-frequency characteristic. As the angular frequency of the input signal approaches infinitely large or infinitely small, the phase shifted in the output signal decreases.

Figure 10:
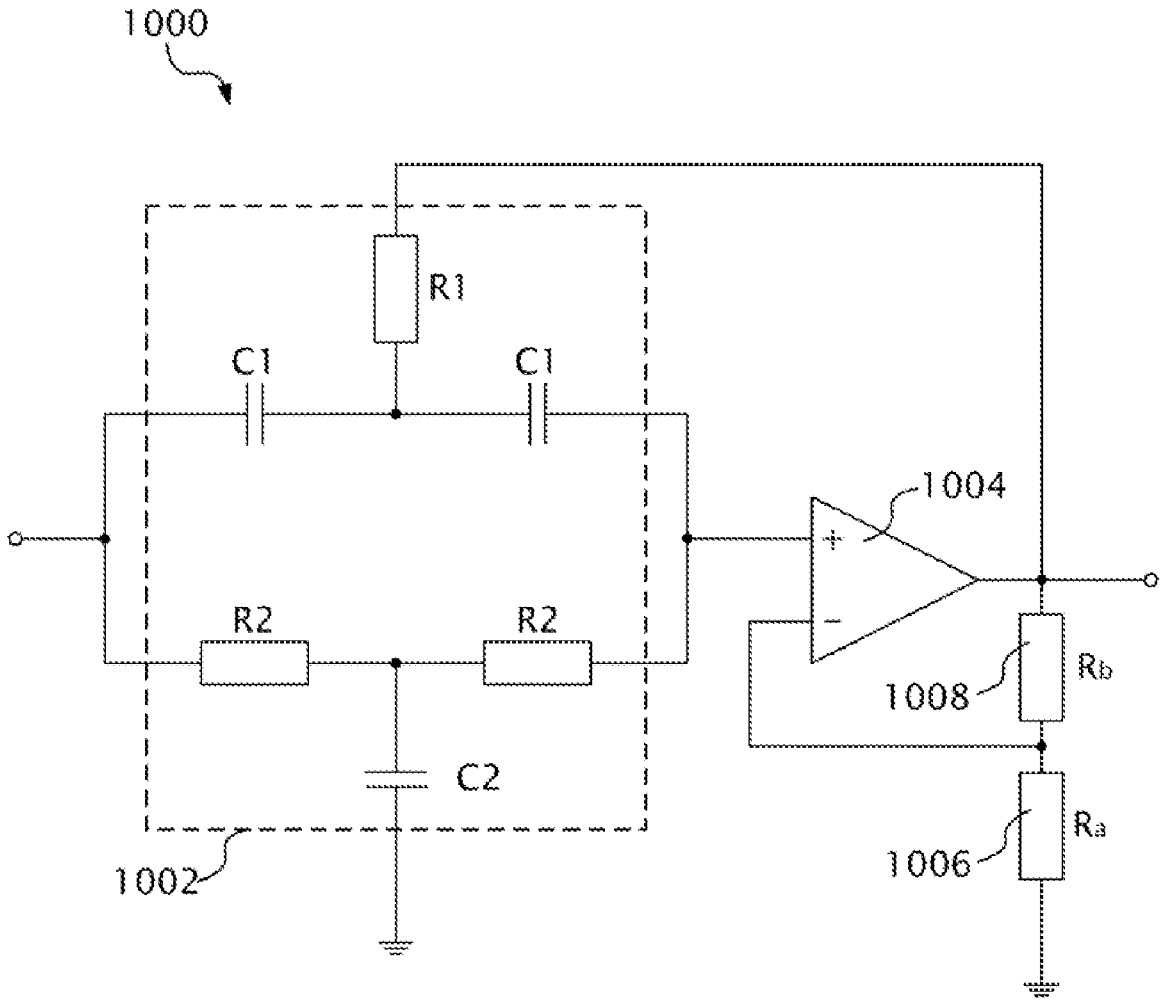
FIG. 10 is a schematic diagram of the filter in accordance with an exemplary embodiment.

Referring to FIG. 10, a schematic diagram of the filter in accordance with an exemplary embodiment is illustrated. The filter 1000 includes a notch type filter 1002, an amplifier 1004, and two voltage-divide resistors 1006, 1008. The notch type filter 1002 has a similar structure to that of the notch type filter 700 as shown in FIG. 7. The amplifier 1004 has an inverting input and a non-inverting input. The outputted signal of the notch type filter 1002 is applied to the non-inverting input of the amplifier 1004. The amplifier 1004 outputs an amplified signal after amplifying the outputted signal of the notch type filter 1002. The amplified signal is fed back to the inverting input of the amplifier 1004 after divided by the two voltage-divide resistors 1006 and 1008.

The transfer function of the filter 1000 can be represented by the equation:

$$A(s) = \frac{V_o(s)}{V_i(s)} = \frac{A_{VF}[1 + s/\omega_0]^2}{1 + 2(2 - A_{VF})s/\omega_0 + (s/\omega_0)^2}, \text{ or}$$

$$A(j\omega) = \frac{V_o(s)}{V_i(s)} = \frac{A_{VF}[1 + (j\omega/\omega_0)^2]}{1 + 2(2 - A_{VF})j\omega/\omega_0 + (j\omega/\omega_0)^2} = \frac{A_{VF}[1 + (j\omega/\omega_0)^2]}{1 + \frac{1}{Q} \cdot j\omega/\omega_0 + (j\omega/\omega_0)^2};$$

wherein $A_{VF}$ refers to an amplification of the amplifier 1004, and Q refers to a Quality factor (Q factor) of the filter 1000. The amplification $A_{VF}$ can be expressed by an equation $$A_{VF} = 1 + \frac{R_b}{R_a},$$

wherein $R_a$ and $R_b$ respectively stand for the resistances of the two voltage-divide resistors 1006 and 1008. The quality factor Q can be expressed by an equation $$Q = \frac{1}{2(2 - A_{VF})}.$$

As the amplification $A_{VF}$ of the amplifier 1004 approaches 2, the quality factor tends to become infinitely large. The filter 1000 may adjust a frequency pass band by adjusting the amplification $A_{VF}$ of the amplifier 1004. The adjustment of the amplification $A_{VF}$ of the amplifier 1004 may be accomplished by choosing different voltage-divide resistors 1006 and 1008.

By incorporating the filter 1000, the ballast is able to filter out noise in the feedback signal ACM, thus the non-overlap time which is determined according to the feedback signal ACM is stable. Further, the brightness of the CCFLs may be stablized, and ignition failures may be avoided.

What is claimed is:

1. A ballast comprising:

a drive circuit comprising an adaptive non-overlap timer, a driver, and a drive controller, the driver being configured for generating a drive signal on receiving a power signal;

a half-bridge inverter for generating a power AC signal according to the drive signal generated by the driver, the power AC signal being fed back to the drive circuit, the power AC signal being used for determining a non-overlap time of the drive signal;

a transformer for generating a high frequency signal based on the power AC signal, the high frequency signal being configured for lightening a lamp, and maintaining the lightening of the lamp; and a filter for filtering out noise in the feedback power AC signal;

wherein the adaptive non-overlap timer is configured for determining a non-overlap time according to the filtered feedback power AC signal, and the drive controller is used for controlling the non-overlap time of the drive signal according to the determined non-overlap time.

2. The ballast as claimed in claim 1, wherein the adaptive non-overlap timer determines the non-overlap time of the drive signal according to a slope of the filtered feedback power AC signal.

3. The ballast as claimed in claim 1, wherein the filter is a notch type filter.

4. The ballast as claimed in claim 3, wherein the notch type filter comprises a high-pass filter circuit for filtering out noise with low frequencies and a low-pass filter circuit for filtering out noise with high frequencies.

5. The ballast as claimed in claim 4, wherein the high-pass filter circuit and the low-pass filter circuit are connected in parallel with each other.

6. The ballast as claimed in claim 4, wherein the high-pass filter comprises a first resistor and two first capacitors; the two first capacitors are connected in series; one end of the first resistor is connected between the two first capacitors.

7. The ballast as claimed in claim 4, wherein the low-pass filter comprises a second capacitor and two second resistors; the two second resistors are connected in series; one end of the second capacitor is connected between the two second resistors.

8. The ballast as claimed in claim 1, wherein the filter comprises a notch type filter and an amplifier, the notch type filter is used for filtering out noise in the feedback power AC signal, and the amplifier is used for amplifying an outputted signal of the notch type filter.

9. The ballast as claimed in claim 8, wherein the amplifier comprises an inverting input and a non-inverting input, the outputted signal of the notch type filter is applied to the non-inverting input of the amplifier, and an amplified signal outputted from the amplifier is fed back to the inverting input.

10. The ballast as claimed in claim 9, wherein the filter further comprises two voltage-divide resistors that are serially connected to an output of the amplifier; the inverting input of the amplifier is connected between the two voltage-divide resistors.

11. The ballast as claimed in claim 10, wherein the amplified signal is coupled to ground via the two voltage-divide resistors.

12. A ballast comprising:

a driver for outputting a high-side drive signal and a low-side drive signal, the high-side drive signal and the low-side drive signal are high-leveled alternatively;

an inverter comprising a high switch transistor for receiving the high-side drive signal and a low switch transistor for receiving the low-side drive signal, the high switch transistor and the low switch transistor are serially connected for outputting a power AC signal, the power AC signal being fed back to the driver;

an adaptive non-overlap timer for receiving the feedback power AC signal, and determining a non-overlap time of the high-side drive signal and the low-side drive signal according to the feedback power AC signal; and a transformer for outputting a high frequency signal based on the power AC signal, the power AC signal being used for lighting a lamp and maintaining the lightening of the lamp.

13. The ballast as claimed in claim 12, wherein the ballast further comprises a filter connected between the inverter and the adaptive non-overlap timer, the filter is used for filtering out noise in the feedback power AC signal.

14. The ballast as claimed in claim 13, wherein the filter is a notch type filter.

15. The ballast as claimed in claim 13, wherein the filter is a twin T notch type filter that comprises a T type high-pass filter circuit and a T type low-pass filter circuit that are connected in parallel with each other.

16. The ballast as claimed in claim 15, wherein the high-pass filter comprises a first resistor and two first capacitors; the two first capacitors are connected in series; one end of the first resistor is connected between the two first capacitors;

the low-pass filter comprises a second capacitor and two second resistors; the two second resistors are connected in series; one end of the second capacitor is connected between the two second resistors.

17. The ballast as claimed in claim 13, wherein the filter comprises a notch type filter for filtering out noise in the feedback power AC signal and an amplifier for amplifying an outputted signal of the notch type filter.

18. The ballast as claimed in claim 17, wherein the filter further comprises two voltage-divide resistors that are serially connected to an output of the amplifier; an inverting input of the amplifier is connected between the two voltage-divide resistors, and a non-inverting input of the amplifier is connected to an output of the notch type filter.

* * * * *

UNITED STATES PATENT AND TRADEMARK OFFICE

CERTIFICATE OF CORRECTION

PATENT NO. : 7,714,518 B2
APPLICATION NO. : 11/770749
DATED : May 11, 2010
INVENTOR(S) : Shih-Fang Wong, Tsung-Jen Chuang and Jun Li It is certified that error appears in the above-identified patent and that said Letters Patent is hereby corrected as shown below:

Please replace Section (73) regarding "Assignees" on the front page of the Patent with the following:

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

Signed and Sealed this

Twenty-first Day of September, 2010

David J. Kappos

David J. Kappos
*Director of the United States Patent and Trademark Office*